US006811377B2

(12) United States Patent
Tang

(10) Patent No.: US 6,811,377 B2
(45) Date of Patent: Nov. 2, 2004

(54) CEILING FAN BLADE

(76) Inventor: David Tang, No. 3, Alley 5, Lane 66, Yangming St., Fengyuan City, Taichung Hsien (TW)

( * ) Notice: Subject to any disclaimer, the term of this patent is extended or adjusted under 35 U.S.C. 154(b) by 0 days.

(21) Appl. No.: 10/455,987

(22) Filed: Jun. 5, 2003

(65) Prior Publication Data

US 2003/0235503 A1 Dec. 25, 2003

(30) Foreign Application Priority Data

Jun. 19, 2002 (TW) ..... 91209153 U

(51) Int. Cl.[7] ..... F04D 29/38

(52) U.S. Cl. ..... 416/132 A; 416/210 R; 416/240

(58) Field of Search ..... 416/132 R, 132 A, 416/135, 210 R, 240

(56) References Cited

U.S. PATENT DOCUMENTS 511,442 A * 12/1893 Lundell ..... 416/225

D321,935 S * 11/1991 Ignon ..... D23/413

5,462,407 A * 10/1995 Calvo ..... 416/132 A

* cited by examiner

*Primary Examiner*—Ninh H. Nguyen

(74) *Attorney, Agent, or Firm*—Charles E. Baxley

(57) ABSTRACT

A ceiling fan blade comprises a cloth blade, a plurality of springs and an arctuated frame. The arctuated frame is provided with a protrusive shaft for cooperating with the springs. The cloth blade forms an inclined angle for pushing air. Meanwhile, by taking advantage of the spring at the inner side of the cloth blade to hook the protrusive shaft of the adjacent frame, whereby to stabilize the inclined angle for pushing air and prevent the torsion oscillation as well. Furthermore, the structure of the cloth blade is not only easy for reassembling and dismantling and cleaning, but also can be folded for storage and transportation, substantially cutting down the storing space.

3 Claims, 4 Drawing Sheets

CEILING FAN BLADE

BACKGROUND OF THE INVENTION

1. Field of the Invention

The present invention relates to ceiling fan blade, and more particularly to a ceiling fan blade structure comprising cloth blade, springs and arctuated frame, which is not only easy for reassembling and dismantling and cleaning, but also can be folded for storage and transportation, substantially cutting down the storing space.

2. Description of the Prior Arts

With the development and improvement of people's life, ceiling fan has become one of the indispensable domestic electric equipments. The ceiling fans sell in market are varied. However, due to the structure of the conventional blade occupies large space of storage and hard to be cleaned. Thereby whether the ceiling fan blade is easy for cleaning or the storage space is saved or not have become the most important features that the user cares most, and to develop a novelty ceiling fan blade structure which can solve the above-mentioned problems is motivation of this invention.

All the conventional ceiling fan blade assembly includes a plurality of blades mounted to a fan holder and then fixed to the rotator. Each of the blades must occupy a certain space and inclined at a certain angle for pushing the air. Such kind of blades have been widely sell and used, however, there are still some disadvantages need to be improved:

First, due to the conventional blades must have certain area and inclined angle for pushing air (should have certain amount of length and width), which will result in difficulties for users in case of storing the blades away, further will accordingly increase the cost for transportation and package.

Second, the conventional blades are fixed plate members (weight is not light), the users have to dismantle the whole set of the ceiling fan first and then the blades by tools, and finally clean the blades one by one, it is time-consuming.

Third, the shape and color of the conventional blades are regular, it is difficult to replace and reassemble or dismantle it, and thereby normally the manufacturers didn't develop the optional changeable blades.

The present invention has arisen to mitigate and/or obviate the afore-described disadvantages of the conventional ceiling fan blades.

SUMMARY OF THE INVENTION

The primary object of the present invention is to provide a ceiling fan blade comprising cloth blade, springs and arctuated frame, which is able to greatly cut down the storage space.

The second object of the present invention is to provide a ceiling fan blade comprising cloth blade, springs and arctuated frame, the cloth blade of which can be replaced and cleaned easily.

The further object of the present invention is to provide a ceiling fan blade that is characterized as the easy replaceable and storage spacesaving structure, such that allows the manufacturers to develop varied cloth blades in different forms and colors, accordingly the users will have much more choices and replace the blades by themselves (DIY) so as to match with the domestic decoration.

The present invention will become more obvious from the following description when taken in connection with the accompanying drawings, which shows, for purpose of illustrations only, the preferred embodiment in accordance with the present invention.

DETAILED DESCRIPTION OF THE PREFERRED EMBODIMENT

Figure 1:
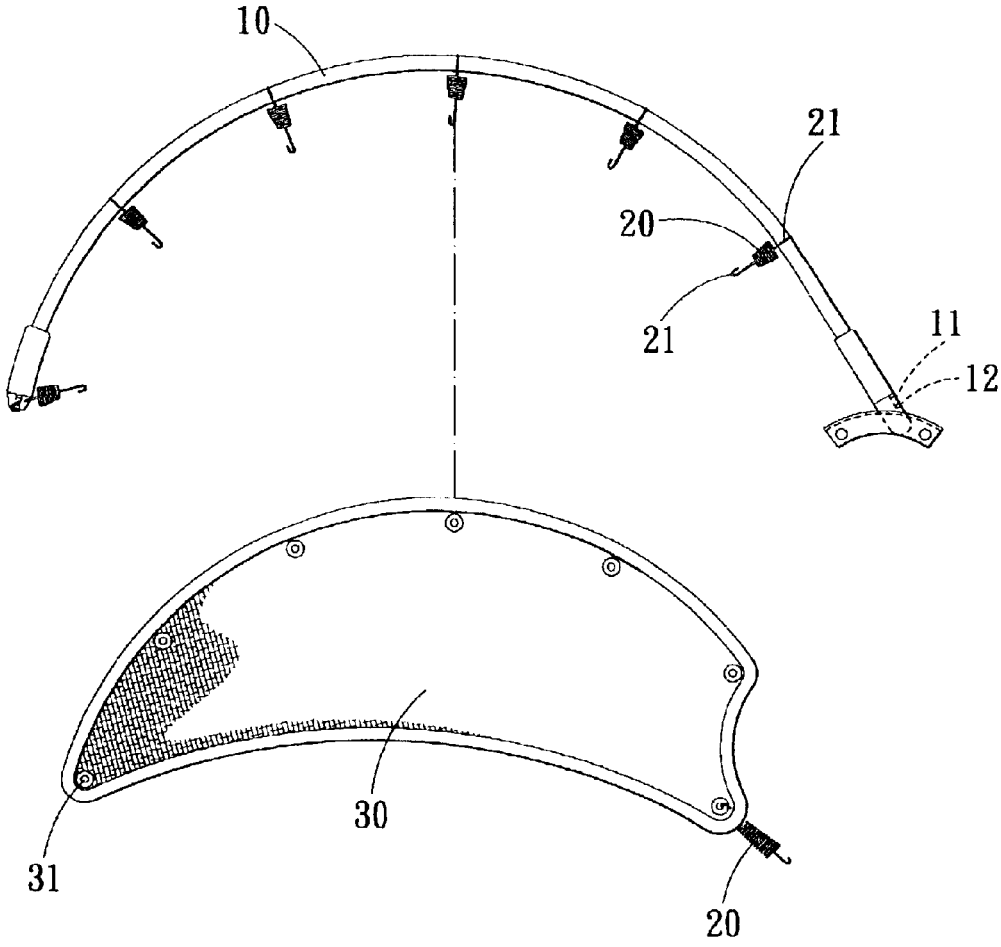
FIG. 1 is an exploded view of a ceiling fan blade in accordance with the present invention.
Figure 2:
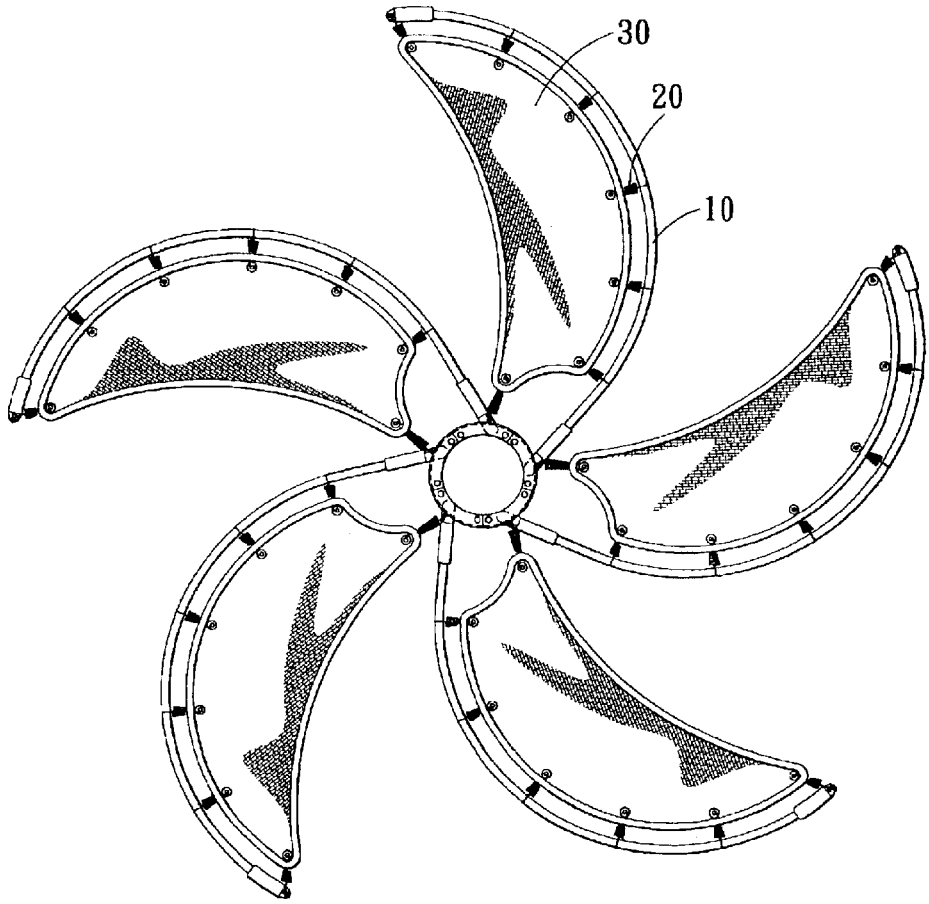
FIG. 2 is an elevational view of a ceiling fan blade assembly in accordance with the present invention.
Figure 3:
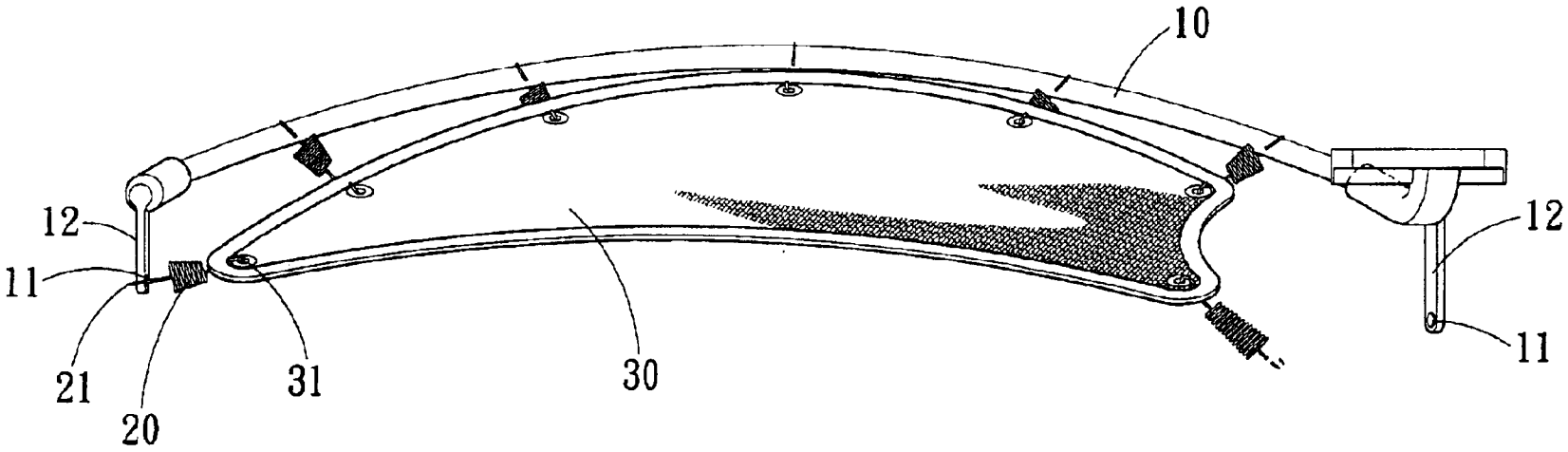
FIG. 3 is a side view of a ceiling fan blade in accordance with the present invention.
Figure 4:
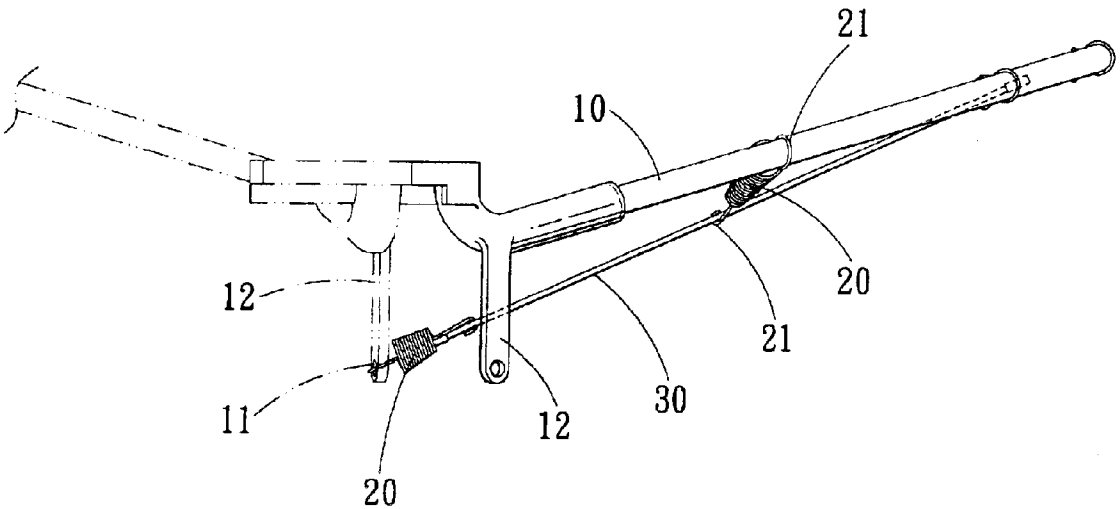
FIG. 4 is a side view of a frame of the blade in accordance with the present invention.

A ceiling fan blade assembly comprises a plurality of independent blades, for easy explanation, here takes a blade as example. Please refer to FIGS. 1–4, wherein a ceiling fan blade of the present invention is shown and comprises a frame 10, a plurality of spring 20 and a cloth blade 30.

The frame 10 is a rod member and has an end fixed to a rotating assembly of a ceiling fan, the frame 10 is arched at a predetermined angle and provided at both ends of the rod with a protrusive shaft 12 respectively, at the end of each protrusive shafts 12 a coupling portion 11 is further defined.

The springs 20, each of which is provided with a hook 21 at both ends respectively, and the hooks 21 at one end of the springs 20 are employed to hook the frame 10 as well as the coupling portions 11 of the protrusive shafts 12.

The cloth blade 30 is corresponding to the frame 10 and provided at the side facing the frame 10 with a plurality of apertures 31 defined by metal rings. The apertures 31 of the cloth blade 30 serve to receive the hooks 21 of another end of the springs 20. In addition, the aperture 31 of the cloth blade 30 proximal to the center of the blade holder is hooked by a spring 20 and connect with the coupling portion 11 in the protrusive shaft 12 of the adjacent frame 10.

Due to the cloth blade 30 is hooked to the frame 10 by virtue of springs 20, which accordingly may be reassembled and dismantled (no tools needed at all), the springs 20 can be dismantled by hand. Moreover, the cloth blade 30 is made of soft cloth, which can be folded for storage and transportation, substantially cut down the storing space.

On the other hand, the aperture 31 of the cloth blade 30 proximal to the center of the blade holder is hooked by a spring 20 and connected with the coupling portion 11 in the protrusive shaft 12 of the adjacent frame 10, by such a manner, the torsions among the respective frames 10 are balanced in a connecting manner, in case of the rotation of each cloth blade 30, the adjacent frames 10 will provide balanced torsion so as to prevent the torsion oscillation of the ceiling fan.

It will be noted that the reassemble and dismantle of the cloth blades 30 doesn't need any tools to be used at all, only needs to take off the springs 20 and the blades 30 easily by hand, moreover, the cloth blades 30 can be easily produced and stored. Thereby the special features of the present allow the manufacturers to develop varied cloth blades 30 in different forms and colors, accordingly the users will have much more choices and replace the blades by themselves (DIY) so as to match with the domestic decoration.

While we have shown and described various embodiments in accordance with the present invention, it should be clear to those skilled in the art that further embodiments may be made without departing from the scope of the present invention.

What is claimed is:

1. A ceiling fan blade for mounting to a rotating assembly of a ceiling fan, comprising:

a frame being a rod member and having an end fixed on a rotating assembly of a ceiling fan, the frame being provided at both ends of the rod member with a protrusive shaft respectively, at the end of each protrusive shafts defined with a coupling portion;

a plurality of springs each having a hook defined at both ends respectively, and the hooks at one end of the springs employed to hook the frame as well as the coupling portions of the protrusive shafts;

a cloth blade corresponding to the frame and provided at the side facing the frame with a plurality of apertures, the apertures of the cloth blade serving to receive the hooks of another end of the springs, in addition, the aperture of the cloth blade proximal to the center of the blade holder hooked by a spring and connecting with the coupling portion in the protrusive shaft of the adjacent frame.

2. The ceiling fan blade as claimed in claim 1, wherein the frame can be a rod member and arched at a predetermined angle.

3. The ceiling fan blade as claimed in claim 1, wherein the apertures of the cloth blade can be defined by metal rings.

* * * * *